US005110401A

United States Patent [19]

Huang

[11] Patent Number: 5,110,401

[45] Date of Patent: May 5, 1992

[54] ADHESIVE TAPE CUTTER

[76] Inventor: Harrison Huang, No. 23, Lin T'so Rd., Taiwan, Taiwan

[21] Appl. No.: 567,759

[22] Filed: Aug. 15, 1990

[51] Int. Cl.[5] ..... B32B 31/00

[52] U.S. Cl. ..... 156/527; 156/577; 156/579

[58] Field of Search ..... 156/577, 579, 527, 584, 156/384, 574, 523, 540, 541

[56] References Cited

U.S. PATENT DOCUMENTS

| | | | |
|---|---|---|---|
| 1,234,215 | 7/1917 | Rhode | 156/527 |
| 2,486,470 | 11/1949 | Fritzinger | 156/527 |
| 3,369,952 | 2/1968 | Rieger | 156/577 |
| 3,753,839 | 8/1973 | Funke et al. | 156/527 |
| 3,951,726 | 4/1976 | Found | 156/577 |
| 3,972,769 | 8/1976 | Lissoni | 156/577 |

*Primary Examiner*—Robert A. Dawson
*Assistant Examiner*—David Reifsnyder
*Attorney, Agent, or Firm*—Cushman, Darby & Cushman

[57] ABSTRACT

An adhesive tape cutter enabling the user to have a smart control on an adhesive tape roll is provided. The cutter includes a handle securing thereto a base piece fixing thereto a cutting device and a tape mounting which includes a shaft, a carrier, a pressing piece, a positioner, a stopper and an elastic member mounted between the stopper and the pressing piece. The tape mounting further includes two protecting metal pieces respectively mounted between the base piece and the carrier as well as the carrier and the pressing piece, and two abrasive pieces respectively mounted between the base piece and the respective one of the metal pieces as well as the other metal piece and the pressing piece.

7 Claims, 7 Drawing Sheets

ADHESIVE TAPE CUTTER

BACKGROUND OF THE INVENTION

1. Field of the Invention

The present invention relates to a packing device, and more particularly to an adhesive tape cutter.

2. Description of the Related Art

A conventional adhesive tape cutter 10, as shown in FIGS. 1~4, includes a handle 11 attached to a metal base plate 12 respectively secured to a cutting device 20 and a tape mounting 30 which carries thereon an adhesive tape roll 40. The cutting device 20 includes amounting piece 21 having an end fixed to base plate 12, a cutting edge 22 fixed to the mounting piece 21 and, a roller 23 having an end rotatably attached to the base plate 12. A positioning plate 24 fixes the free end of piece 21 and rotatably fixes the free end of roller 23 for mounting piece 21 and roller 23 on plate 12. A cooperating plate 13 provided on handle 11 is held beneath roller 23 and urged against roller 23 by a torsional spring (not shown) cooperates with roller 23 to form therebetween a clearance for passing therethrough the adhesive tape 41 from roll 40. In roller 23 presses tape 41 against the article to be applied with tape 41 and then edge 22 cuts tape 41 as desired.

Tape mounting 30 includes a shaft 31 having an end fixed to base plate 12 and a free end having a flattened portion 311. A carrier 32 is rotatably mounted on shaft 31 and carries thereon a roll 40. A positioner 33 which is coaxially adjustable and fixed into the shaft free end. A pressing piece 34, having an elongate hole 341, engages therein the flattened portion 311. A stopper 35 is sleeved on positioner 33. A spring 36 is mounted between pressing piece 34 and stopper 35 for biassing pressing piece 34 against carrier 32. A washer 37 is mounted between carrier 32 and pressing piece 34 and a sleeve 38 is mounted between carrier 32 and base plate 12.

Since spring 36 biasses piece 34 against carrier 32 through washer 37, tape roll 40 will have a rotational friction which results from the friction respectively occurring between washer 37 and pressing piece 34, washer 37 and carrier 32 and sleeve 38 and base plate 12. This rotational friction effects the tape-applying operation in that the rotational friction is of an enough magnitude, then the user can tightly, smoothly and perfectly apply the tape on the article to be tape-applied. Therefore, the user can neatly cut the tape so that the phenomena of a massed tape while the user is applying the tape on an article and an inadvertent tape slack while cutting the tape can be obviated.

Since sleeve 38, washer 37 and carrier 32 are plastic, even if positioner 33 is screwed into shaft 31 to the largest exent possible the rotational friction of tape roll 40 is still insufficient in that the plastic itself has a lubricating effect. In addition, sleeve 38, washer 37 and carrier 32 wear away relatively easily (since in practice, washer 37 and pressing piece 34 rarely relatively rotate) so that the rotational friction of tape roll 40 gradually reduces. Furthermore, if carrier 32 wears away to a serious extent, an entire new cutter 10 is needed since a carrier 32 cannot be independently obtained. Also, in continuous rapid packaging operation, the adhesive tape 41 easily escapes from the clearance between roller 23 and cooperating plate 13 (as shown in FIG. 4) to result in a massed tape which not only causes a waste in tape 41 and time, but is also troublesome.

SUMMARY OF THE INVENTION

It is therefore an object of the present invention to provide an adhesive tape cutter capable of imparting a relatively high rotational friction to an adhesive tape roll.

It is further an object of the present invention to provide an adhesive tape cutter having a tape roll carrier incapable of being easily worn away.

It is additional an object of the present invention to provide an adhesive tape cutter in which the adhesive tape cannot easily escape from the position which it is supposed to reside in.

According to the present invention, an adhesive tape cutter includes a handle secured to a base piece respectively fixed to a cutting device and a tape mounting. The tape mounting carries an adhesive tape roll. The tape mounting includes a shaft, a carrier, a pressing piece, a positioner, a stopper and an elastic member mounted between the stopper and the pressing piece. The tape mounting further includes two protecting metal pieces respectively mounted between the base piece and the carrier as well as the carrier and the pressing piece. The tape mounting also includes two abrasive pieces respectively mounted between the base piece and the respective one metal piece as well as the other metal piece and the pressing piece.

The present invention may best be understood through the following description with reference to the accompanying drawings, in which:

DETAILED DESCRIPTION OF THE PREFERRED EMMBODIMENT

Figure 1:
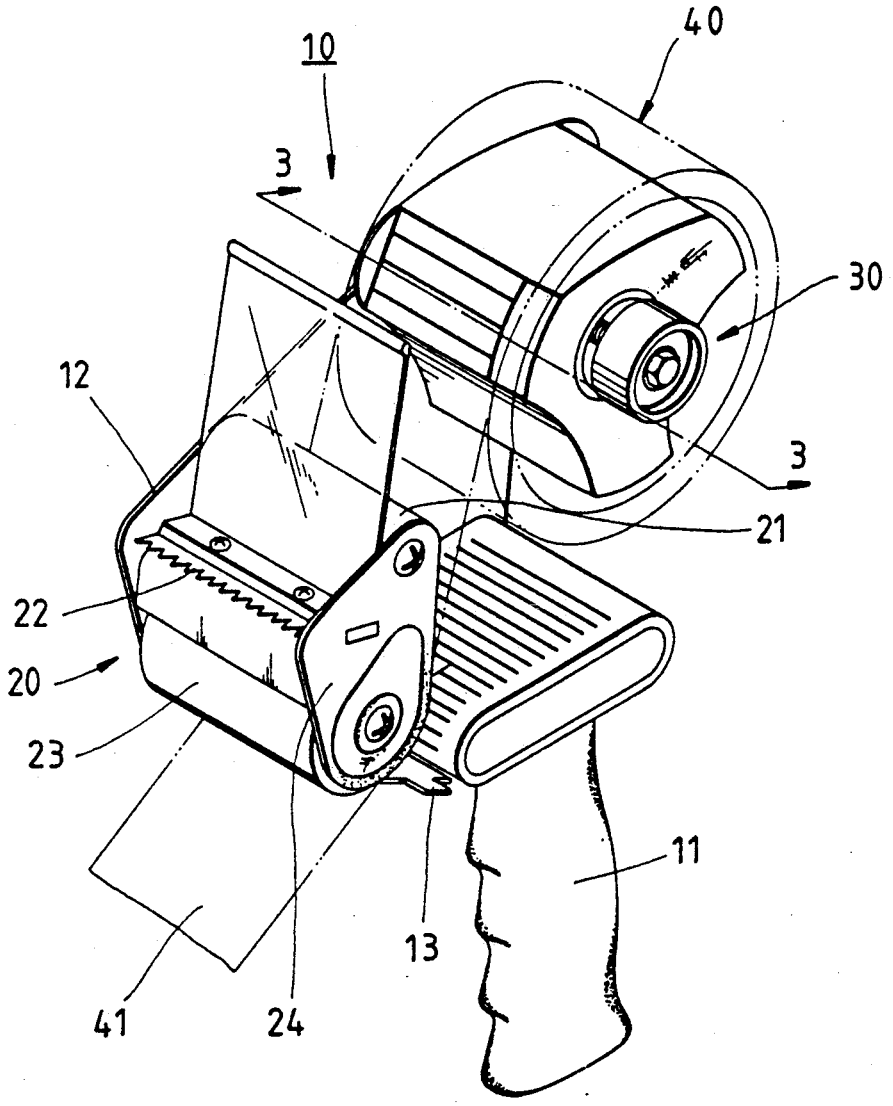
FIG. 1 PRIOR ART
FIG. 1 is a perspective view showing an adhesive tape cutter according to the prior art.
Figure 2:
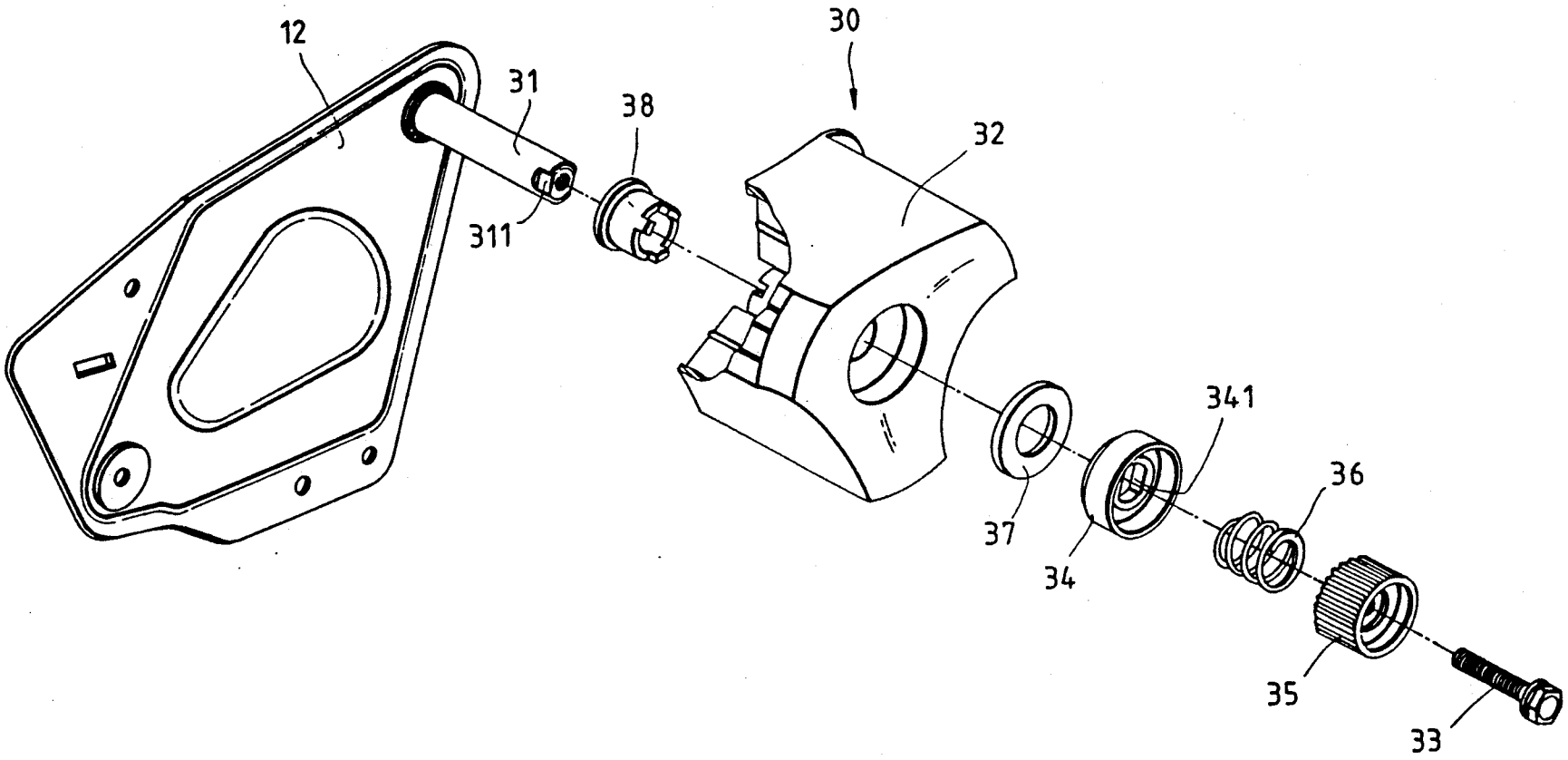
FIG. 2 PRIOR ART
FIG. 2 is an exploded view showing a tape mounting to an adhesive tape cutter in FIG. 1.
Figure 4:
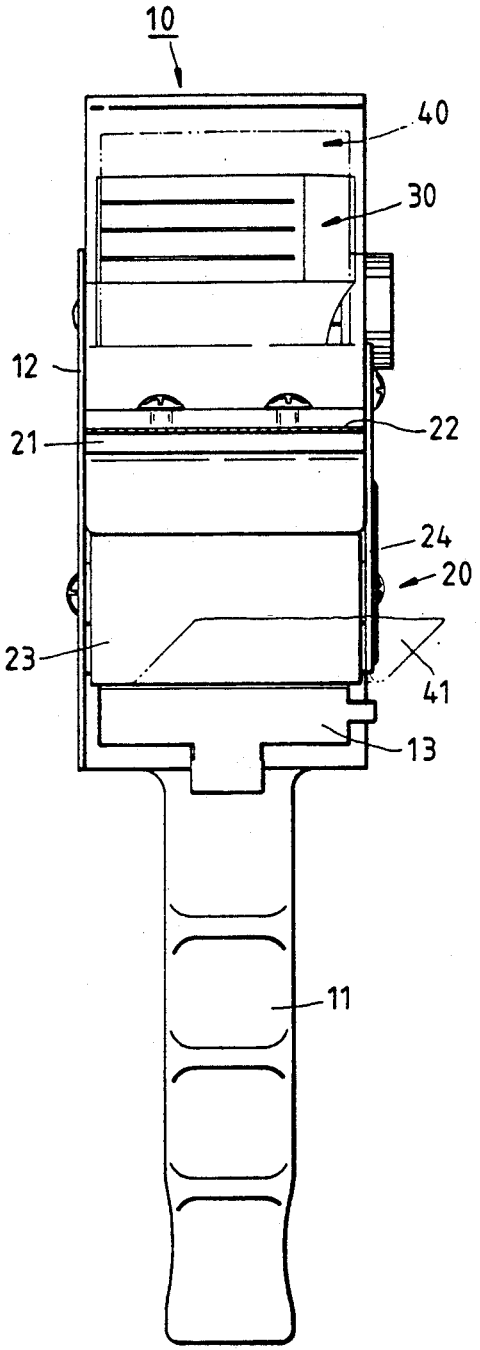
FIG. 4 PRIOR ART
FIG. 4 is a front view showing an adhesive tape cutter in FIG. 1.
Figure 3:
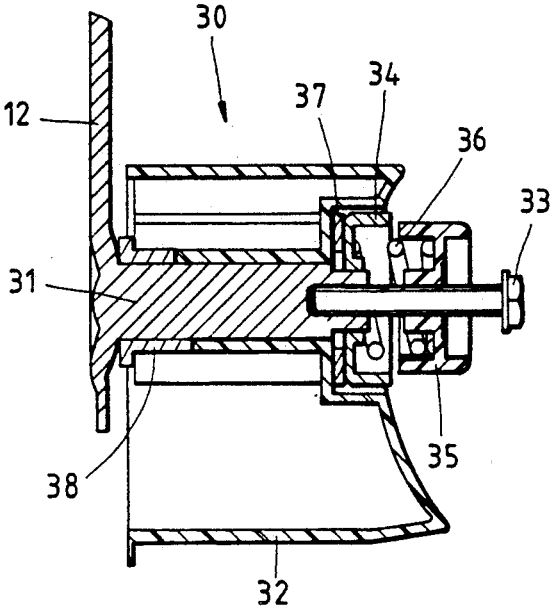
FIG. 3 PRIOR ART
FIG. 3 is a sectional view taken along line 3—3 in FIG. 1.
Figure 5:
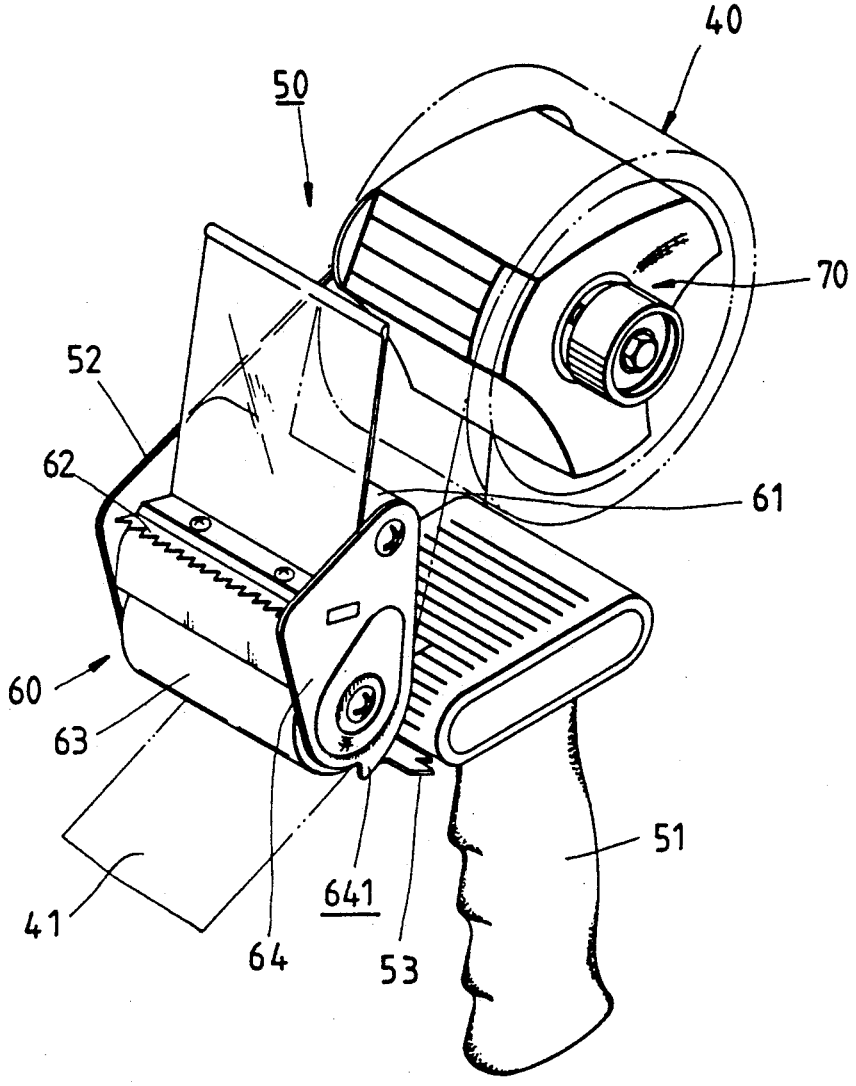
FIG. 5 is a perspective view showing a first preferred embodiment of an adhesive tape cutter according to the present invention.
Figure 6:
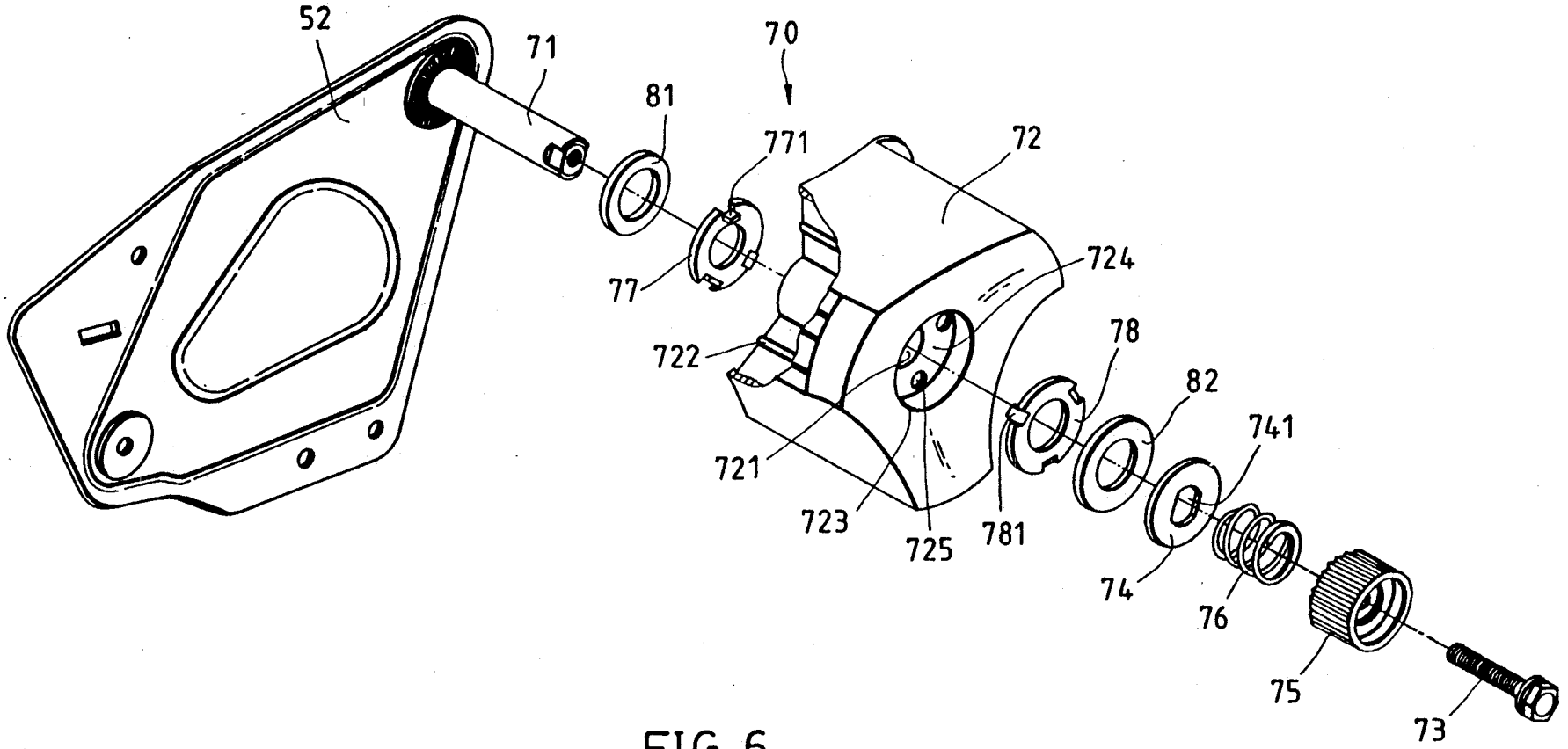
FIG. 6 is an exploded view showing a tape mounting of an adhesive tape cutter in FIG. 5.
Figure 9:
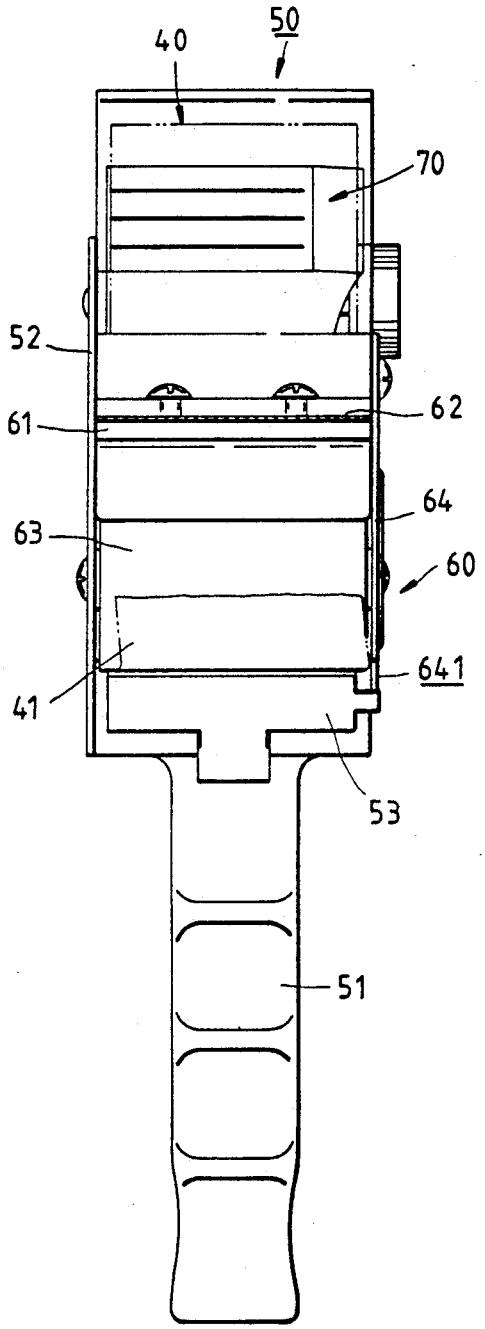
FIG. 9 is a front view showing an adhesive tape cutter in FIG. 5.
Figure 7:
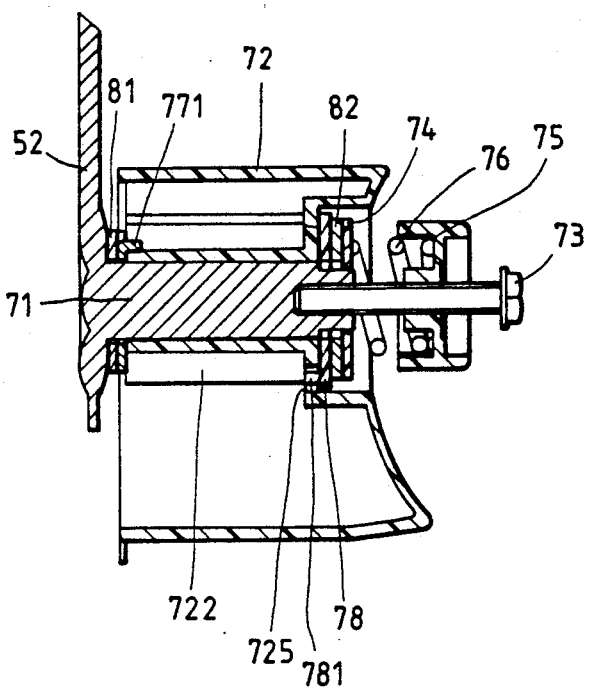
FIG. 7 is a sectional view taken along line 7—7 in FIG. 5.
Figure 8:
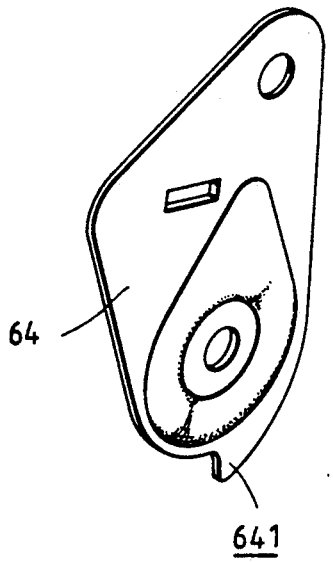
FIG. 8 is a perspective view of a positioning plate of an adhesive tape cutter in FIG. 5.

Referring now to FIGS. 5~9, an adhesive tape cutter 50 according to the present invention includes a handle 51 securing thereto a base plate 52 respectively fixing at the front and the rear thereof a cutting device 60 and a tape mounting 70, and a cooperating plate 53 mounted on handle 51 and urged by a torsional spring (not shown) against cutting device 60 to form therebetween a clearance for passing therethrough an adhesive tape.

Tape mounting 70 includes a shaft 71, a carrier 72, a positioner 73, a pressing piece 74, a stopper 75 and a spring 76. Carrier 72, capable of carrying thereon an adhesive tape roll, has a through hole 721. Passing through hole 721 is a shaft 71. Three inner reinforcing ribs 722, and an end recess 723 forming a shoulder surface 724 are evenly provided with three holes 725. Pressing piece 74 is a metal ring and has a slot 741 slidably but not rotatably receiving therein a flattened end portion 711 of shaft 71. Tape mounting 70 further includes two protecting metal pieces 77, 78 respectively mounted between base plate 52 and carrier 72 as well as carrier 72 and pressing piece 74. Two abrasive pieces 81, 82, made of an asbestos having a high coefficent of abrasion are respectively provided between base 52 and metal piece 77 as well as metal piece 78 and pressing piece 74. Each of the metal pieces 77, 78 is generally annular and has three evenly disposed projections 771, 781 so that the projections 781 can respectively engage in holes 725 and projections 771 can respectively engage with ribs 772, so that the carrier 72 and metal pieces 77, 78 rotate synchronously. The rotational friction of carrier 72 is thus increased by the provisions of the metal pieces 77, 78 and the asbestos pieces 81, 82.

Cutting device 60 includes a mounting piece 61, a cutting edge 62, a roller 63 and a positioning plate 64. Plate 64 has a lower extension 641 serving as a closing piece capable of preventing the adhesive tape from escaping from the clearance between roller 63 and the cooperating plate 53 so that the user can continuously and smoothly obtain adhesive tape from the adhesive tape roll.

Figure 10:
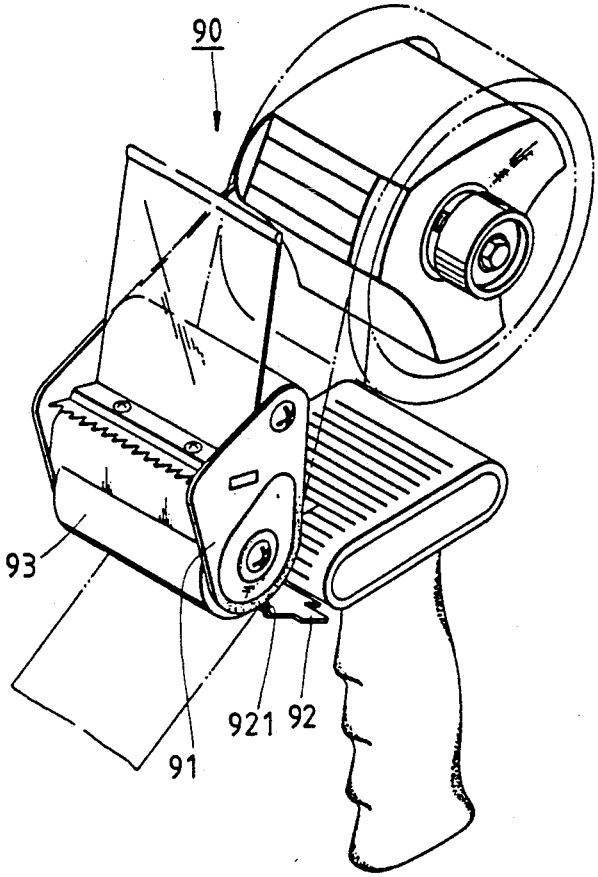
FIG. 10 is a perspective view showing a second preferred embodiment of an adhesive tape cutter according to the present invention.
Figure 11:
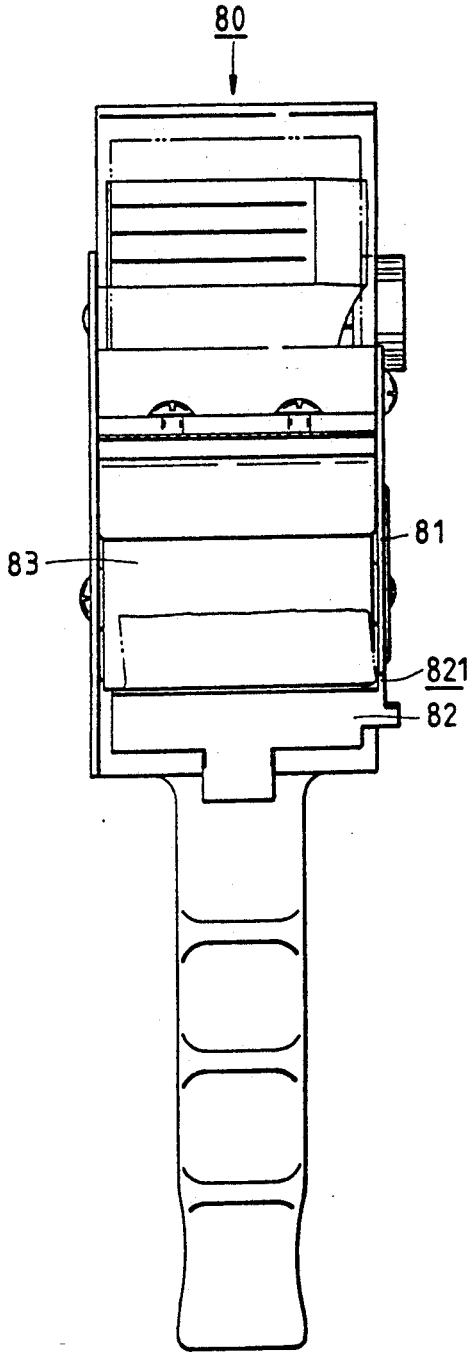
FIG. 11 is a front view showing an adhesive tape cutter in FIG. 10.

FIGS. 10 & 11 show a second preferred embodiment of the adhesive tape cutter 90 according to the present invention. The tape cutter 90 is structurally identical to cutter 50 with the exception that the positioning plate 91 and cooperating plate 92 are structurally slightly different from plates 64 and 53, respectively. Positioning plate 91 does not have a lower extension and cooperating plate 92 has an upper projection 921 serving as a closing piece capable of closing the adhesive tape in the clearance formed between the roller 93 and the cooperating plate 92 when the present cutter 90 is in use.

What I claim is:

1. An adhesive tape cutter comprising:

a handle;

a base piece secured to said handle;

a cutting device fixed to said base piece;

a tape mounting fixed to said base piece; and means for mounting an adhesive tape roll on said tape mounting, said tape mounting including:

a shaft having a first end fixed to said base piece and a second free end;

a carrier rotatably mounted to said shaft and having means for carrying thereon said tape roll;

a pressing piece being limitedly slidable but not rotatably mounted on said free end;

a positioner adjustably coaxially fixed into said free end;

a stopper sleeved on said positioner;

an elastic member mounted between said stopper and said pressing piece for biassing said pressing piece against said carrier;

two protecting metal pieces respectively mounted between said base piece and said carrier as well as said carrier and said pressing piece; and two abrasive pieces respectively mounted between said base piece and a respective one of said metal pieces as well as the other said metal piece and said pressing piece.

2. An adhesive tape cutter according to claim 1, further comprising a cooperating plate held beneath said cutting device having means for passing therebetween an adhesive tape from said roll, and a spring for urging said cooperating plate against said cutting device.

3. An adhesive tape cutter according to claim 2 wherein said cutting device includes:

a mounting piece having a first end secured to said base piece and a second free end;

a cutting edge fixed to said mounting piece;

a roller held above said cooperating plate to form therebetween a clearance for passing therethrough said adhesive tape and having a first end rotatably attached to said base piece and a second free end; and a positioning plate fixing thereto said free end of said mounting piece and rotatably fixing thereto said roller free end, and a closing piece for preventing said adhesive tape from escaping from said clearance is provided.

4. An adhesive tape cutter according to claim 3 wherein said closing piece is extended from said positioning plate beyond said clearance.

5. An adhesive tape cutter according to claim 3 wherein said closing piece is extended from said cooperating plate.

6. An adhesive tape cutter according to claim 3 wherein said pressing piece is made of metal.

7. An adhesive tape cutter according to claim 6 wherein said pressing piece is relatively resistant to abrasion.

* * * * *